United States Patent [19]

Shannon

[11] Patent Number: 4,938,396

[45] Date of Patent: Jul. 3, 1990

[54] SYRUP DISPENSING SYSTEM

[75] Inventor: Joseph W. Shannon, Kent, Ohio

[73] Assignee: ABC/Sebrn Tech. Corp., Akron, Ohio

[21] Appl. No.: 195,276

[22] Filed: May 18, 1988

[51] Int. Cl.[5] ..... B67D 5/30

[52] U.S. Cl. ..... 222/641; 222/642; 222/71; 222/129.1; 222/249; 222/263; 222/334

[58] Field of Search ..... 222/639–644, 222/129.1–129.4, 136, 137, 334, 249, 250, 252, 255, 263, 52, 61, 63, 71

[56] References Cited

U.S. PATENT DOCUMENTS

| | | | |
|---|---|---|---|
| 2,427,429 | 9/1947 | Waite et al. | 222/129.2 X |
| 2,566,436 | 9/1951 | Waite | 222/129.4 X |
| 2,736,466 | 2/1956 | Rodth | 222/129.2 X |
| 4,124,146 | 11/1978 | Sealfon | 222/641 |
| 4,484,697 | 11/1984 | Fry, Jr. | 222/95 |
| 4,687,120 | 8/1987 | McMillin | 222/129.1 X |

FOREIGN PATENT DOCUMENTS

| | | | |
|---|---|---|---|
| 2441836 | 7/1980 | France | 222/644 |
| 2146621 | 4/1985 | United Kingdom | 222/640 |

OTHER PUBLICATIONS

Zehnder catalogue–Bag–in–Box Systems & Accessories (pp. 2–8).

*Primary Examiner*—Kevin P. Shaver

*Attorney, Agent, or Firm*—Renner, Kenner, Greive, Bobak, Taylor & Weber

[57] ABSTRACT

A syrup dispensing system in which a pump is actuated at a preset clock rate under a fixed pressure head. The clock rate and pressure head are tailored to accommodate the lowest operating temperature for the system and, accordingly, the thickest syrup. A preset amount of syrup is dispensed on each clock cycle such that a constant rate of syrup flow is attained.

9 Claims, 1 Drawing Sheet

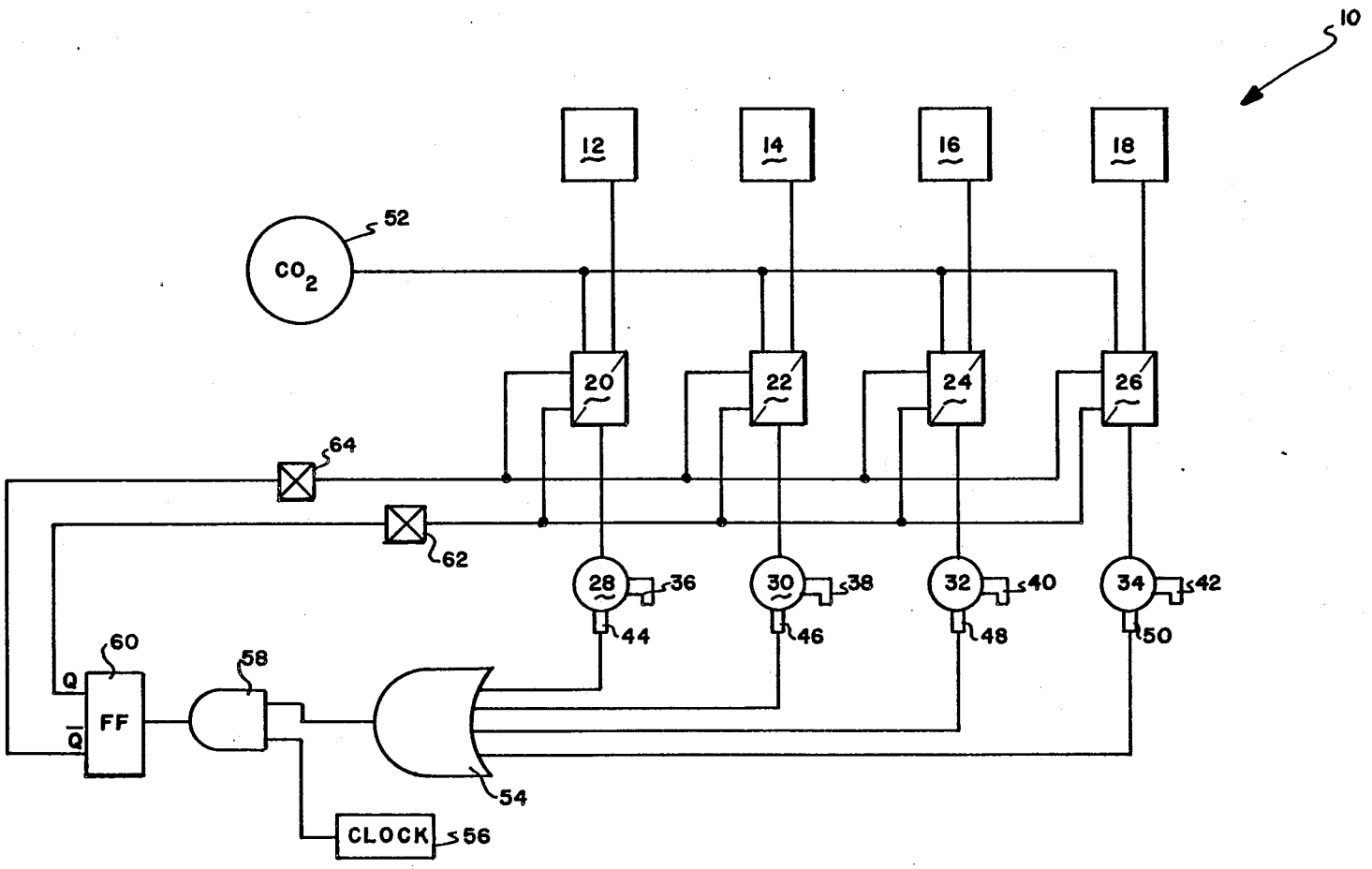
10
12
14
16
18
20
22
24
26
28
30
32
34
36
38
40
42
44
46
48
50
52
$CO_2$
54
56
CLOCK
58
60
FF
Q
$\overline{Q}$
62
64

SYRUP DISPENSING SYSTEM

TECHNICAL FIELD

The invention herein resides in the art of beverage dispensing systems and, more particularly, to systems for dispensing soft drinks or carbonated beverages. Specifically, the invention relates to a syrup dispensing system for beverage dispensers for syrup-based beverages.

BACKGROUND ART

It is well known that soft drinks are typically made by combining a syrup with carbonated water or soda. In the soft drink industry, it is known that the flow rate of syrup is a function of its viscosity and that the viscosity is a function of temperature. As the temperature drops, sugar-based syrups become thicker and, for a given pressure head, flow slower through the system. In like manner, as the temperature rises, such syrups become thinner and, for a given pressure head, flow more rapidly throughout the system. Accordingly, temperature or viscosity compensation must be considered for soft drink dispensing systems to assure a consistency in the brix level of the soft drinks dispensed, irrespective of temperature or syrup viscosity.

Previously, it has been proposed to rechamber the syrup from a bulk supply, monitor temperature of the rechambered syrup, and adjust the dispensing pressure head and/or dispensing cycle times to assure a proper amount of syrup is dispensed. While such systems are extremely accurate and reliable in operation, they are expensive to manufacture. Such systems typically require sophisticated electronic control circuitry, including the requisite software and firmware for control of the microprocessor systems which are often employed.

Previously, there has been no known way to dispense syrup from a bulk reservoir such as a pressurized canister or the now-popular "bag-in-a-box," or to assure a constant syrup flow rate or dispensing volume irrespective of syrup temperature or viscosity.

DISCLOSURE OF INVENTION

In light of the foregoing, it is a first aspect of the invention to provide a syrup dispensing system in which a fixed syrup flow rate is obtainable and unaffected by temperature variations.

Another aspect of the invention is the provision of a syrup dispensing system which is readily adapted for implementation with existing soft drink systems.

Yet a further aspect of the invention is the provision of a syrup dispensing system which operates consistently and reliably without changes in head pressure or dispensing cycle times.

Yet an additional aspect of the invention is the provision of a syrup dispensing system which achieves consistent and reliable dispensing without the need for rechambering of the syrup.

Certain of the foregoing and other aspects of the invention which will become apparent as the detailed description proceeds are achieved by a syrup dispensing system for a soft drink dispenser, comprising: a bulk supply of syrup; a pump connected to and receiving syrup from said bulk supply; a dispensing head in syrup-receiving communication with said pump; and means connected to said pump for assuring a fixed rate of flow of syrup to said dispensing head independent of the temperature or viscosity of the syrup.

Yet additional aspects of the invention are obtained by a syrup dispensing system, comprising: a bulk supply of syrup; a dispensing head; a positive displacement pump interposed between said bulk supply and said dispensing head; and means connected to said positive displacement pump for selectively actuating said pump for periods of time sufficient to dispense a predetermined volume of syrup irrespective of the temperature or viscosity of said syrup.

DESCRIPTION OF DRAWING

For a complete understanding of the objects, techniques and structure of the invention, reference should be had to the following detailed description and accompanying drawing wherein there is shown a schematic diagram of the syrup dispensing system of the invention.

BEST MODE FOR CARRYING OUT THE INVENTION

Referring now to the drawing, it can be seen that a syrup dispensing system according to the invention is designated generally by the numeral 10. The system includes a plurality of bulk syrup supplies 12–18, which may either comprise pressurized canisters or aseptically packaged syrup, known in the art as the "bag-in-a-box" bulk supply system. It will be appreciated that any of numerous bulk supplies might be used in accordance with the invention and each may constitute a different flavor, sugar-based or diet syrup. Each of the bulk supplies 12–18 communicates with a respective pump 20–26 as shown. In a preferred embodiment of the invention, the pumps 20–26 are positive displacement pneumatic pumps. By this, it is meant that the pumps operate off of a source of air or gas pressure and are operative to dispense a fixed quantity of syrup upon each stroke of a piston through an associated cavity. In the present embodiment of the invention, it is contemplated that the pumps 20–26 are dual cavity and dual piston pumps, one cavity being filled while the other dispenses in normal operation. In other words, the pistons reciprocate and are 180° out of phase with each other. Each cavity is provided with its own exhaust port, the cavity being exhausted as it is filled with fluid or syrup. With the operation of the pistons being interdependent, one cavity is exhausted for refilling while the other cavity dispenses the syrup therein. In such a pump, inhibiting or closing the exhaust port of one cavity prevents dispensing from the other. Accordingly, one can control dispensing from the pumps 20–26 by simply opening and closing the exhaust ports thereof.

In the preferred embodiment of the invention, the pumps employed are McCann's Mini-Pump Model-B, distributed by McCann's of Los Angeles, Calif. Such pumps are diaphragm operated and pressurized by a source of gas or air pressure. As shown in the instant embodiment, such source of pressure is designated by the carbon dioxide source 52. The diaphragm prevents contact of the pressurized gas with the syrup such that the syrup does not become carbonated. Again, each cavity of the pump is specifically adapted to dispense a fixed volume of syrup, such as 6–7 ml on each dispensing cycle.

Associated with each of the pumps 20–26 is a dispensing head 28–34 having an associated syrup dispensing tube or orifice 36–42 associated therewith. It will also be understood by those skilled in the art that soda tubes would also be presented in juxtaposition to the syrup tubes 36–42 to achieve a desired mix for the ultimate soft drink or carbonated beverage.

Associated with each of the dispensing heads 28–34 is a respective pour switch 44–50 or other appropriate signal source. Such switch is adapted to emit a signal indicating that beverage is being requested once a glass is placed under the dispensing head and into contact with the switch. It will, of course, be understood that the switch may also be manually actuated by an operator or, indeed, the signal may be generated by some type of processor control.

As mentioned above, a source of gas or air pressure 52 is provided as the pressure or actuation medium of the pumps 20–26. In a preferred embodiment, carbon dioxide gas is maintained under pressure at the source 52 for communication with the pumps. In the preferred embodiment of the invention, the carbon dioxide at the source 52 is maintained at a pressure head sufficient to allow the pumps 20–26 to move syrup at a desired rate at the lowest temperature and correspondingly thickest viscosity of the syrup to be anticipated in a normal operational environment of the beverage dispensing system. It will, of course, be understood by those skilled in the art that the thicker the syrup, the slower the cycle time of the pumps 20–26, for any given head pressure. An increase in cycle time may be obtained by increasing the head pressure.

As shown in the drawing, pour signals from the switches or sources 44–50 for each of the dispensing heads 28-34 are passed to an OR gate 54 such that an output is evidenced from the gate 54 in the event that any of the dispensing heads is requesting the dispensing of syrup and beverage. The output of the OR gate 54 is combined with a clock 56 at the AND gate 58. The clock signal frequency from the clock 56 is set at a cycle time sufficient to accomplish a desired dispensing rate from the pumps 20–26 at the lowest expected temperature and thickest viscosity for the syrups in the operating environment. With an understanding of the operation of the system, the establishment of such clock frequency will be appreciated. However, it will be understood that it is most desired that the frequency of the clock signal from the clock 56 be set to accommodate the lowest expected operational temperature and the highest viscosity.

The AND gate 58 presents the clock signal at the output thereof any time that there is an output from any of the pour switches or signal sources 44–50. This clock pulse passed to a FLIP FLOP 60, most preferably a D-type FLIP FLOP. Upon each clock pulse, outputs of the FLIP FLOP 60 toggle or change state, as is well known to those skilled in the art. The true (Q) output of the FLIP FLOP 60 is connected to an exhaust valve 62 which is connected to a corresponding one of the exhaust ports of each of the pumps 20–26 while the complimentary (Q) output is connected to an exhaust valve 64 which is connected to the corresponding other exhaust port of each of the pumps 20–26. Accordingly, one exhaust port of all pumps 20–26 is enabled and the other is inhibited on each clock pulse and that state is toggled on each subsequent clock pulse. Accordingly, each clock pulse will allow the dispensing of an amount of syrup contained within one of the cavities of the associated dual cavity pump 20–26. By setting the frequency of the clock 56 in proper relation to the pressure head provided by the gas source 52, it can be assured that a desired rate of syrup dispensing can be attained even at the lowest anticipated operational temperature and consequently highest viscosity of the syrup. Since the pumps 20–26 are positive displacement pumps, dispensing a fixed known quantity of syrup on each cycle or half cycle, the flow rate or dispensing rate of the syrup is fixed and not viscosity dependent. Accordingly, drinks of guaranteed consistency can be dispensed irrespective of temperature or viscosity variations.

The operation of the syrup dispensing system 10 will now be discussed with respect to, for example, dispensing head 28. Once a request for beverage is made at the dispensing head, a signal is emitted as, for example, by the pour switch 44. At the same time, a request for syrup is made from the pump 20, at the output thereof. The switch 44 passes through the OR gate 54 and enables the clock signal from the clock 56 to pass through the AND gate 58. The FLIP FLOP 60 thus toggles at a rate determined by the clock frequency, alternately and mutually exclusively enabling and inhibiting valves at the two exhaust ports at the pump 20. Accordingly, dispensing of syrup is accomplished by the passage of a fixed predetermined volume of syrup during the period of each clock pulse. Once the pour signal terminates, the AND gate 58 is inhibited and the pump 20 is similarly inhibited, terminating dispensing.

It will be appreciated that the system 10 allows for the simultaneous dispensing of syrup and beverage at all or any combination of the dispensing heads 28–34. The presence of a "pour" signal at the OR gate 54 allows the passage of the clock pulse 56 to the FLIP FLOP 60 and the toggling output thereof to each of the pumps 20–26. The dispensing of beverage is, however, only obtained from those pumps whose outputs are opened as by actuation of the associated pour switch 44–50 which opens a corresponding dispensing valve.

Thus it can be seen that the objects of the invention have been satisfied by the structure and technique presented hereinabove. The syrup system of the invention allows for consistent fixed rates of syrup flow irrespective of temperature or viscosity over a broad range of operating conditions. By tailoring the clock frequency and pressure head to accommodate the lowest anticipated operating temperatures, this guarantee of assured flow rate can be maintained. While in accordance with the patent statutes only the best mode and preferred embodiment of the invention has been presented and described in detail, it is to be understood that the invention is not limited thereto or thereby. Accordingly, for an appreciation of the true scope and breath of the invention, reference should be had to the appended claims.

What is claimed is:

1. A syrup dispensing system for a soft drink dispenser, comprising:

at least one bulk supply of syrup;

at least one dual cavity dual piston positive displacement pump connected to and receiving syrup from said bulk supply;

at least one dispensing head in syrup-receiving communication with said pump; and means connected to said pump for assuring a fixed rate of flow of syrup to said dispensing head independent of the temperature or viscosity of the syrup, said means comprising a clock operatively connected to said pump for enabling and disabling said pump at a set clock rate; and switching means interconnected between said clock and said pump for mutually exclusively enabling said dual pistons of said pump.

2. The syrup dispensing system according to claim 1 which further includes means associated with said dispensing head for generating a signal indicating a request for syrup from said pump.

3. The syrup dispensing system according to claim 2 wherein said signal enables and inhibits said operative connection of said clock to said pump.

4. The syrup dispensing system according to claim 3 wherein means are provided for said pump to provide a preset pressure head applied thereto.

5. The syrup dispensing system according to claim 4, wherein said at least one bulk supply of syrup comprises a plurality of bulk supplies of syrup, wherein said at least one pump comprises an equal plurality of pumps, one pump connected to and receiving syrup from an associated one of said bulk supplies of syrup, and wherein said at least one dispensing head comprises an equal plurality of dispensing heads, one dispensing head in syrup receiving communication with a respective one of said pumps.

6. The syrup dispensing system according to claim 5 wherein said clock is operatively connected to each of said pumps for enabling and disabling selected ones of said pumps at said set clock rates.

7. A syrup dispensing system, comprising:

a bulk supply of syrup;

a dispensing head;

a dual cavity dual piston positive displacement pump interposed between said bulk supply and said dispensing head; and means connected to said positive displacement pump for selectively actuating said pump for periods of time sufficient to dispense a predetermined volume of syrup irrespective of the temperature or viscosity of such syrup, said means comprising a clock generator producing clock pulses of fixed frequency, said pump passing a fixed quantum of syrup to said dispensing head on each clock pulse to maintain a fixed rate of said syrup, means between said clock generator and said pump operative to mutually exclusively enable and disable respective exhausts of said dual cavities.

8. The syrup dispensing system according to claim 7 wherein said dispensing head has associated therewith means for generating a signal indicating a demand for syrup at said dispensing head, said signal enabling passage of said clock pulses to said pump.

9. The syrup dispensing system according to claim 8 wherein said pump is pressurized by a source of fixed pressure.

* * * * *